US005653805A

United States Patent [19]

Russell et al.

[11] Patent Number: 5,653,805

[45] Date of Patent: Aug. 5, 1997

[54] VEHICLE BODY PANEL POSITIONING APPARATUS FOR PAINT APPLICATION

[75] Inventors: Charles T. Russell, Fair Haven; Gerald G. Kilgore, Jr., Algonac, both of Mich.

[73] Assignee: PTM Corporation, Fair Haven, Mich.

[21] Appl. No.: 556,019

[22] Filed: Nov. 9, 1995

[51] Int. Cl.[6] ..... B05C 13/00

[52] U.S. Cl. ..... 118/503; 118/71; 118/500; 248/352; 248/354.4

[58] Field of Search ..... 118/503, 500, 118/71; 248/352, 354.4; 269/909

[56] References Cited

U.S. PATENT DOCUMENTS 2,865,585 12/1958 Beyer et al. ..... 248/354.4
5,127,359 7/1992 Kannari et al. ..... 118/56

*Primary Examiner*—Donald E. Czaja
*Assistant Examiner*—Steven B. Leavitt
*Attorney, Agent, or Firm*—Barnes, Kisselle, Raisch, Choate, Whittemore & Hulbert, P.C.

[57] ABSTRACT

A positioning method and fixture apparatus for use in painting or coating a vehicle body panel, such as a plastic composite deck lid, when mounted on a pair of existing spring-counterbalanced arms of deck lid hinges. The method and apparatus releasably retains and positions the deck lid by forces applied directly at the hinges rather than to the deck lid. A rigid transverse main strut of the fixture laterally spans the body panel between the hinges and carries a pair of hook members rigidly affixed to its ends that releasably attach one to each associated hinge arm. A secondary strut extends rearwardly from the main strut and has a slide bolt latch to releasably engage the rear underside edge of the deck lid stationary against lid-opening counterbalancing spring forces, and to secure the fixture unitarily to the deck lid at three points. A lid manipulating arm pivotally carded on the secondary strut has spaced notch hooks to hold the deck lid in selected partially open positions for coating application. The fixture is torsionally and longitudinally rigid to prevent torsional stress being exerted by the hinges on the deck lid panel. Additionally, no bending moment in a plane fore and aft of the vehicle is applied to the deck lid by the positioning method because the fixture does not pull down on the deck lid rear latch point but instead attaches directly to the lid hinges in order to manipulate and hold the deck lid.

19 Claims, 3 Drawing Sheets

VEHICLE BODY PANEL POSITIONING APPARATUS FOR PAINT APPLICATION

FIELD OF THE INVENTION

This invention relates to painting and like coating of vehicle body panels, and more particularly to an apparatus for supporting and positioning a vehicle body panel for the application of paint.

BACKGROUND OF THE INVENTION

Quality control standards within the automotive industry continue to become more stringent. Concurrent goals of the industry are to improve vehicle paint finishes, reduce the weight of vehicles, and to simplify and reduce the cost of assembly and manufacturing procedures. One of the means to achieve these goals has been to produce more and more automotive body panels from fiberglass, plastic or composite materials.

Presently, automotive manufacturers are considering producing trunk lids or deck lids for vehicles from fiberglass based sheet molding compounds (SMC) or like plastic composite materials. Deck lids are almost universally carried by a pair of hinges which are attached to the vehicle body structure beneath the rear window. Generally, each of the hinges has a counterbalancing spring which forces the deck lid to a fully open position once the rear trunk latch is released. Deck lids are generally cantilevered from the hinges with the the latch for the deck lid a considerably distance from the pivot of the hinges.

During the first stage of the painting process, the entire vehicle body including the deck lid and hinges is coated with a primer surface during what is known as an E-coat process. The temperature of the E-coat bath is relatively high, usually in the range of about 325° to 450° F. The deck lid latch mechanism is not installed until after the completion of the painting process. During the E-coat process, the preferred method is to position the deck lid in a partially open position. The present procedure is to hold the deck lid partially down with a hook implement, against the force of hinge springs. One end of the hook is attached to the rear of the deck lid near where the latch mechanism would be installed, and the other end of the hook to the lower rear edge of trunk opening of the vehicle body. Since the hinge springs are designed to force the deck lid to an open position, this method of holding the deck lid in the partially open position causes a bending moment on the cantilevered deck lid. As a result, the extreme heat of the E-coat oven and the bending stress caused by the present positioning method tend to warp the fiberglass or plastic deck lid panels.

As the vehicle body passes through the base and clear coat stages of the painting process, the deck lid is preferably re-oriented into an almost fully closed position flush with vehicle body. The current method is again to use a simple hook at the latch point to hold the deck lid in an almost closed position from the inside while the vehicle body passes through the spray booths which apply the finish coats. Again, as a result the warpage which occurs during the E-coat process is enhanced by the continued stress on the deck lid panel and becomes a highly visible coating defect after the smooth and glossy paint finish has been applied. The warpage may also cause misalignment between the deck lid and the vehicle body structure around the trunk opening.

Because of these problems, automotive manufacturers have been extremely reluctant to use fiberglass or plastic composite deck lid panels, especially on upscale or luxury type vehicles, because of the poor quality fit and finish caused by the aforementioned fixturing problems. In accordance with the present invention it has been discovered that what is needed is an improved fixturing method and apparatus that will eliminate the bending stresses exerted on the fiberglass deck lid during E-coat and various paint or other vehicle body coating applications and yet permit the deck lid to be securely held and easily sequentially oriented to fully open, partially open and almost closed positions.

OBJECTS OF THE INVENTION

Accordingly, among the principal objects, features and advantages of the present invention are to provide an improved positioning method and fixturing apparatus utilized for positioning an automotive body panel during all stages of the paint application process, wherein the holding fixture is easily and releasably attached to a pair of existing spring-counterbalanced body panel hinges, securely positions and holds the body panel oriented in more than one predetermined position as needed for each stage of the paint process, significantly reduces torsional stress exerted on the body panel by and between the laterally spaced pair of panel hinge supports during the painting process, essentially eliminates fixturing applied bending stress exerted on the panel as cantilevered from the hinges during the painting process, and wherein the improved fixturing apparatus is reusable, rugged, durable, reliable, and of relatively simple design and economical manufacture.

SUMMARY OF THE INVENTION

The present invention accomplishes the foregoing and other objects by providing a positioning method and fixturing apparatus for use with a vehicle body panel such as a deck lid that is horizontally oriented relative to a vehicle body when closed and mounted on a pair of existing spring-counterbalanced starboard and port arms of deck lid hinges, the hinge arms being spaced laterally apart at or near the front of the side edges of the deck lid, the hinge springs normally biasing the deck lid to a fully open position, wherein the positioning method and apparatus of the invention releasably retains and positions the deck lid by forces applied directly at the hinges rather than to the deck lid.

The positioning fixture apparatus of the invention comprises a primary support having an essentially rigid transverse main brace strut that laterally spans the body panel between the hinges. A pair of hook members are rigidly affixed to the opposite longitudinal ends of the brace member, each being disposed for releasable attachment to an associated one of the hinges. A secondary base strut of the fixture primary support extends rearwardly from a rigid connection at one end to the main strut and has an longitudinally adjustable slide bolt latch at its other end to releasably engage the rear underside edge of the deck lid to secure the fixture unitarily to the deck lid at three points. A pivotal lid manipulating arm is cantilever carried by the secondary brace strut and is angularly adjustable perpendicularly relative to the plane of the deck lid. A first notch hook is provided on the pivotal arm and is disposed on the arm such that the deck lid will be held in a first position when the first notch hook is hooked on a lip of the lower edge trunk opening structure of the vehicle body. A second notch hook is disposed on the pivotal arm for positioning the deck lid in a second position when the second notch hook is hooked on the trunk opening lip.

The transverse main brace strut of the primary support is substantially torsionally and longitudinally rigid such that there is little or no differential torsional moments permitted to be generated between the hook members relative to one another during support thereof by the fixture. This structural rigidity thus will help prevent any torsional stress being exerted by the hinges on the deck lid panel. Additionally, no bending moment in a plane fore and aft of the vehicle is applied to the deck lid by the positioning method of the present invention because the pivotal arm and positioning hook notches do not attach to the deck lid rear latch point but instead attach directly to the lid hinges through the primary support structure of the fixture.

BRIEF DESCRIPTION OF THE DRAWINGS

The foregoing as well as other objects, features and advantages of this invention will be apparent from the following detailed description of the preferred embodiment and the best mode of making and using the same, appended claims, and accompanying drawings (scaled from engineering drawings unless otherwise indicated) in which:

DETAILED DESCRIPTION OF THE PREFERRED EMBODIMENT

Figure 1:
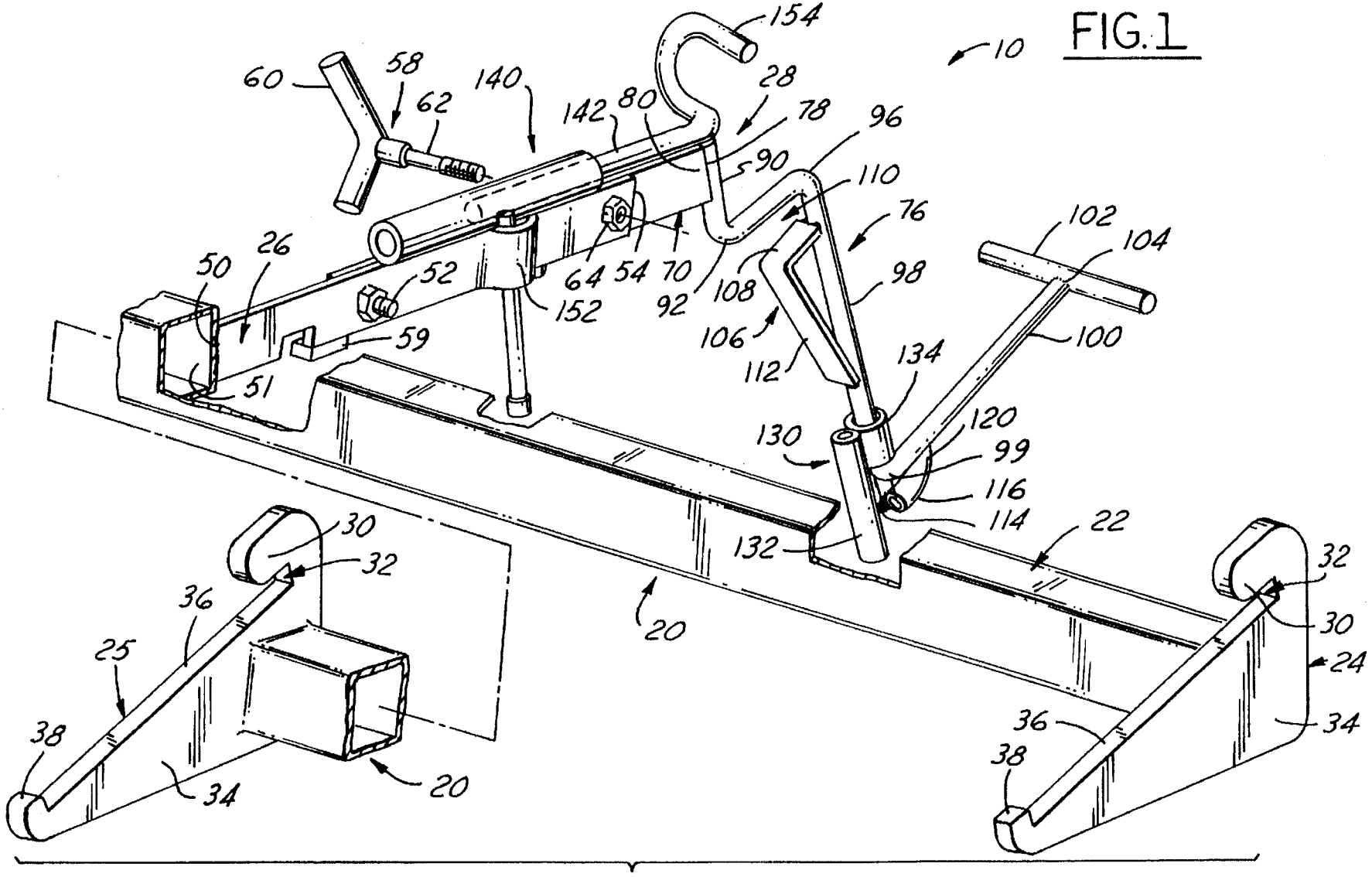
FIG. 1 is a fragmentary perspective view of an exemplary but presently preferred embodiment of a positioning fixture apparatus constructed in accordance with the present invention for performing the positioning method of the invention.

Referring in more detail to the drawings, FIG. 1 illustrates a positioning fixture apparatus 10 for use in the manufacture of vehicles such as automobiles during the application of paint to the vehicle body. The apparatus 10 is especially adapted for use on vehicles having a trunk or deck lid 12 constructed of fiberglass or other thermoplastic composite materials as shown in FIGS. 2–5. During the manufacturing process of applying paint to the vehicle body 14, the deck lid 12 is held sequentially in its proper paint application positions by attaching fixture 10 to the existing starboard and port hinge arms 16 and 17 of spring counterbalanced hinges of the deck lid so as to rigidly and stationarily interconnect the lid hinges through the fixture to the vehicle body at selected lid orientations.

Fixture 10 has a primary support brace 20 of an essentially rigid construction. The primary support brace 20 of the preferred embodiment comprises an elongate transverse main strut 22 spanning the distance laterally of the vehicle body between rearward terminations of the hinge arms 16 and 17. These existing deck lid hinges are conventionally articulated at their opposite ends (not shown) for conjoint pivotal motion about an axis perpendicular to the vertical mid-plane of the vehicle body, and normally biased clockwise as viewed in the drawings by torsion bar counterbalancing springs (not shown) to help raise weight of the deck lid to fully open position by overcoming the gravitational closing force of the deck lid structure. Typically, hinge arms 16, 17 are constructed of a substantially rigid ordinary steel hollow box or other shape channel (round, square, etc.) and terminate rearwardly at open ends. A pair of starboard and port rigid hook members 24 and 25 are welded to opposite longitudinal ends of strut 22, one at each end, for releasably attaching the fixture to the rearward ends of hinge arms 16 and 17 of deck lid 12. Preferably, a secondary strut 26 is rigidly affixed at one end to extend longitudinally perpendicular to the longitudinal axis of main strut 22, by a method such as welding, so as to be cantilever supported at about the midpoint of strut 22. A fixture manipulating arm 28 is pivotally connected to and carried on longitudinal strut 26, and is constructed and arranged to selectively position fixture 10 to hold the vehicle deck lid 12 directly through the hinge arms in one or more predetermined angularly oriented open positions relative to the vehicle body 14, for example the two positions illustrated herein.

Figure 3:
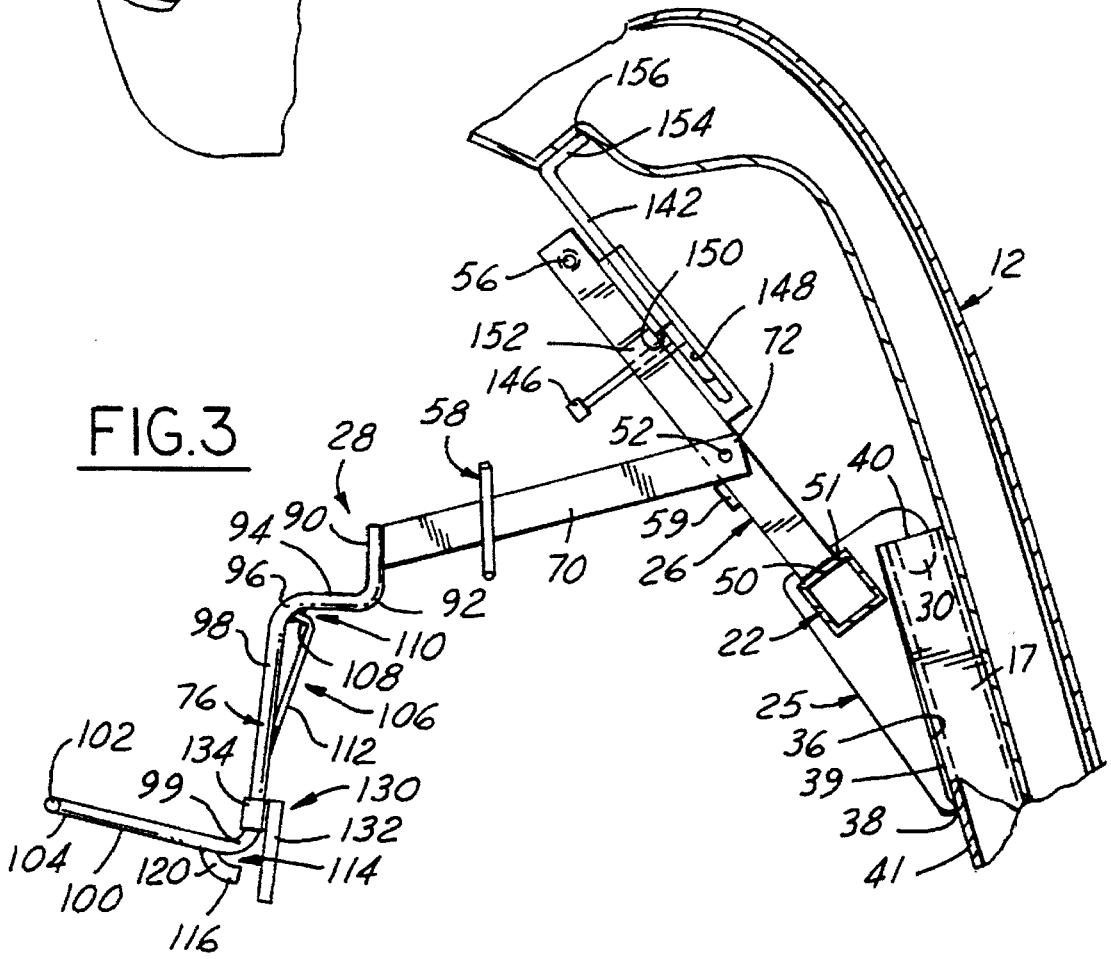
FIG. 3 is a fragmentary sectional view of the deck lid and a hinge taken on the line 2—2 in FIG. 2.
Figure 4:
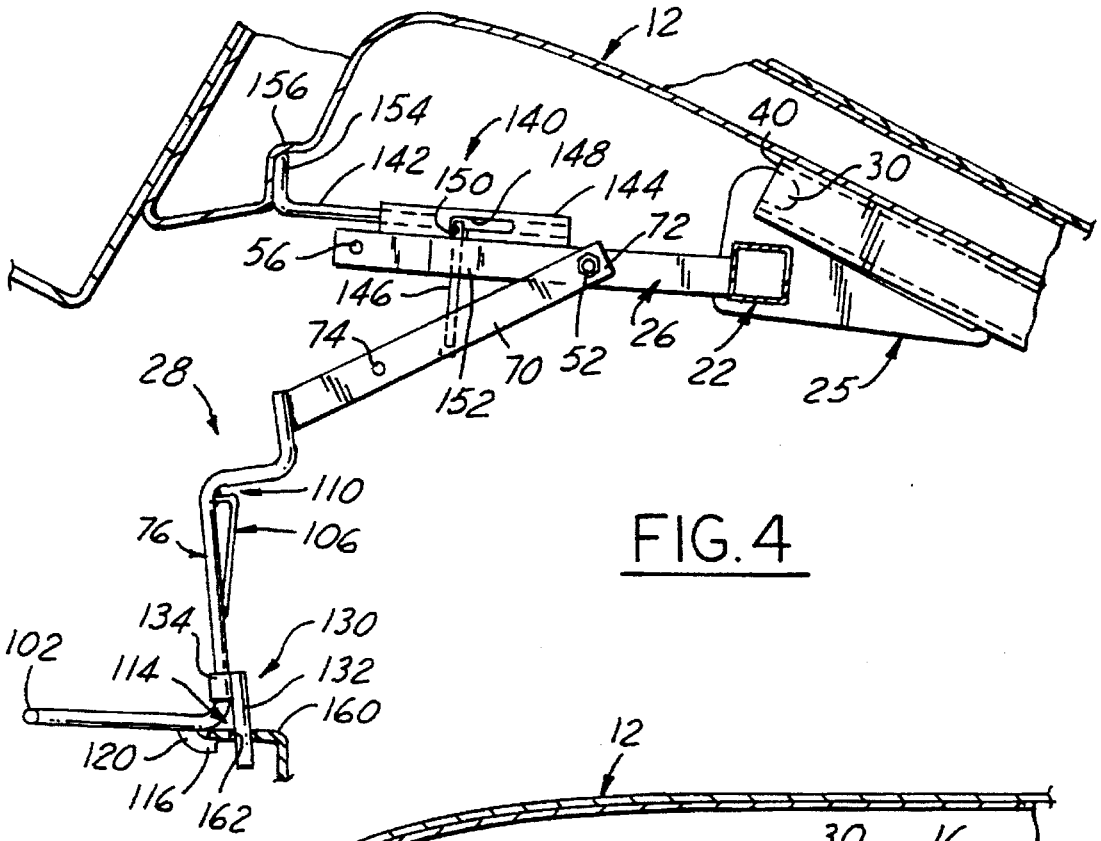
FIG. 4 is a fragmentary part sectional, part side elevational view illustrating the deck lid of FIGS. 1–3 as securely held in a partially open position by the fixture apparatus of the invention.
Figure 5:
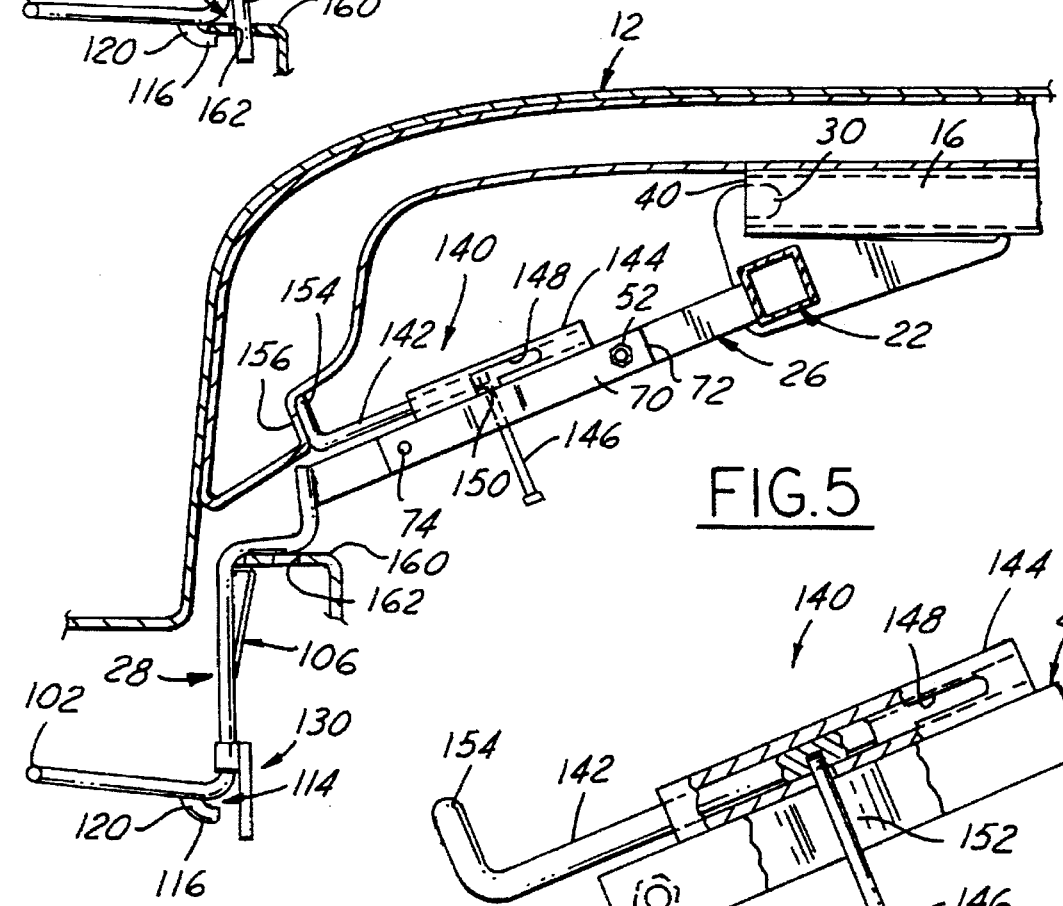
FIG. 5 illustrates the deck lid of FIGS. 1–4 securely held in a substantially closed position by the fixture apparatus of the invention.
Figure 6:
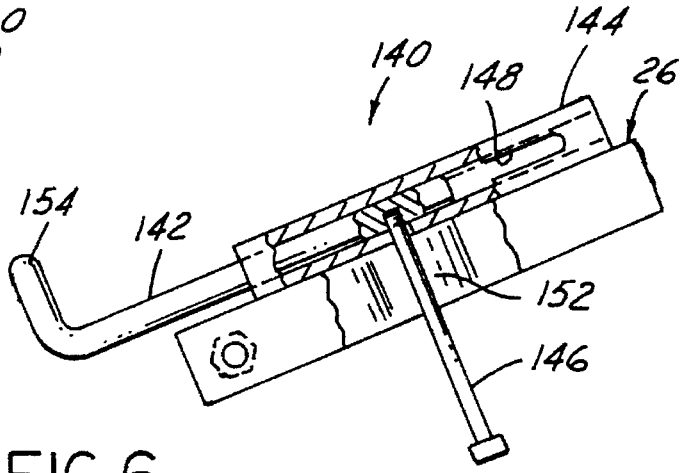
FIG. 6 is a fragmentary part sectional, part elevational view of a portion of the positioning fixture apparatus as shown in FIG. 5 but enlarged thereover.

Each of the hook members 24, 25 is preferably constructed from ordinary flat plate steel having a thickness substantial enough to prevent deformation or bending of the hook members during use. Each of the hook members 24, 25 has a large hook portion 30 integrally extending from one end of a main hook body 34, defining a slot 32 between the hook portion 30 and the facing edge of main body 34. Each hook member 24, 25 also has a hinge facing surface 36 with one end beginning at the interior surfaces defining slot 32 and may be configured to accommodate in closely spaced away relation any number of vehicle hinge surface contours. At the opposite end of the surface 36 is a finger 38 extending from the main body 34 constructed and arranged to abut the facing outer surface 39 of the proximal wall 41 of the box channel of the associated deck lid hinge arms 16, 17. As best illustrated in FIGS. 3–5, the hook portion 30 of each hook member 24, 25 protrudes into an open rearward end 40 of the associated hinge arms 16, 17 such that a portion of proximal wall 41 the hinge arm box channel is received in each slot 32 and each finger 38 abuts the outer surface 39 of wall 41 at a point well spaced from the end of the hinge arm. Thus, most of the abutment surface 36 of each hook member 24, 25 preferably lies spaced away out of contact with each hinge arm 16, 17 when fixture 10 is vehicle installed.

Each main body 34 of the hook members 24, 25 in the preferred embodiment has a generally triangular configuration such that the hook end of each main body has a large enough surface area to accommodate rigid cantilever attachment of the transverse rectangular box channel strut 26. In the preferred embodiment as shown in FIG. 1, each of the opposite longitudinal ends of the strut 26 is welded at its square cut end edge to the associated one of main hook bodies 34 of hook members 24, 25.

The secondary strut 26 is preferably constructed of an elongate flat strip of ordinary steel. Strut 26 is preferably welded at one end 50 to the rear wall 51 of strut 22 at about the midpoint thereof. Strut 26 is preferably oriented such that its width dimension is positioned in the vertical plane, parallel to the major plane of hook bodies 34, and its length dimension extends essentially perpendicular to the longitudinal axis of strut 22. The pivot arm 28 is pivotally carried by strut 26 on a pivot pin 52 passing through an opening in strut 26 nearest its end 50. Pivot pin 52 may take on any number of constructions and yet provide sufficient rotational movement of the pivot arm 28. An outwardly protruding tab 59 (FIGS. 1 and 3) is disposed on the strut 26 for limiting counterclockwise pivotal travel (as viewed in FIG. 3) of the pivot arm 28 relative to strut 26 about the pivot axis of pin 52. Tab 59 may either be welded to strut 26 or formed integrally therewith.

The other end 54 of secondary strut 26 remote from strut 22 has an opening 56 therethrough for receiving therein a pivot arm lock pin 58 (FIG. 1) for locking the pivot arm 28 in storage and second stage position when the apparatus 10 is not in use and in use in second stage lid orientation (FIGS. 1 and 5). In the preferred embodiment, the lock pin has a T-handle 60 for simple hand manipulation at one end and a threaded rod 62 at its other end for being received through opening 56. A threaded nut 64 having corresponding threads is welded to far side of strut 26 concentric with the opening 56 for threadably receiving the lock pin rod 62 therein.

Pivot arm 28 of the preferred embodiment has an elongate flat strip section 70 which pivots on pivot pin 52 at a pivot connection end 72. A lock opening 74 is formed in the flat section 70 (FIGS. 4 and 5) and corresponds with opening 56 in the strut 26 for receiving lock pin 58 therethrough. For providing the positive two-stage deck lid orientation positioning feature of fixture 10, manipulating arm 28 has a dual hook positioning section 76, constructed of ordinary steel rod and form bent to shape, that is attached at one end by a weld to the end edge 78 of flat section 70 at its end 80 remote from its pivot point.

The configuration and construction of the positioning hook section 76 and the flat section 70 of manipulating arm 28 may take on any number of configurations to accommodate any particular vehicle body panel and hinge construction and configuration without departing from the scope of the invention. In the preferred embodiment (as best seen in FIGS. 1 and 3), the positioning section or rod 76 has a top end 90 that is parallel with and welded to the edge 78 of the flat section 70. A first bend 92 is formed in rod 76 to create a first horizontal portion 94 extending away from the flat section 70. A second bend 96 is formed in the rod 76 extending the rod downwardly and merging into a generally vertically oriented mid-section 98. A third bend 99 is formed in the rod and merges into a second generally horizontal portion 100 again extending away from the flat section 70. Rod 76 when so formed is preferably co-planar with the flat strip portion 70 except for a second T-handle 102 which is welded to the distal end 104 of second horizontal portion 100 and oriented perpendicular thereto. A bent metal tab 106 having a short first leg 108 essentially parallel to and spaced apart from the first horizontal portion 94 is welded to the upper end of rod mid-section 98 to form a gap or first hook notch 110 between tab leg 108 and rod portion 94. Tab 106 also has an elongate support leg 112 integral with its first leg 108 also end-welded to rod mid-section 98, to provide structural rigidity to tab 106.

A second gap or hook notch 114 is formed in hook section 76 of arm 28 by welding a curved metal hook 116 to the bottom of the second horizontal portion 100 adjacent third bend 99. One end of hook 116 is welded to the horizontal portion 100 in a transversely abutting relationship, and hook 116 has a bend 120 of about 90° leading to the free end of hook 116 and thereby forming with rod bend 99 the second hook notch 114.

The dual hook position section 76 of fixture manipulating arm 28 also has a releasable slide rod pin latch 130 that is slidably mounted on mid-section 98 between support leg 112 of tab 106 and the third bend 99 of rod 76. Slide pin latch 130 of the preferred embodiment has an elongate metal latch pin 132 extending essentially downwardly and parallel to rod mid-section 98. Pin 132 is welded to a metal loop collar 134 slidably received on rod mid-section 98. Slide pin latch 130 is constructed and arranged such that when lifted into abutment with tab support leg 112 (position not shown), pin 132 clears obstruction to second notch 114 to provide access thereto. When slide pin 130 is permitted to drop to move its collar 134 into contact with rod third bend 99, pin 132 blocks access to the second hook notch 114 in its latching position (FIG. 4).

For providing additional fixture support for deck lid 12 at its rear free end and for preventing hook members 24 and 25 from releasing from hinge arms 16, 17, a slide bar latch 140 is mounted on the top of secondary strut 26 of fixture 10. Slide bar latch 140 has an elongate slide bolt 142 slidably received in a cylindrical tube 144 disposed on top of strut 26 with its axis essentially parallel to the longitudinal axis of strut 26. Tube 144 is preferably welded to the top edge of strut 26. Extending perpendicularly from the slide bolt 142 is a slide arm 146 for manually maneuvering the slide bolt in both a linear and a rotational manner. Tube 144 has a linear slot 148 through and along one side of the tube through which the slide arm protrudes.

At the one end of the tube slot 148 nearest the remote opening slot 248 and free end of strut 26, tube 144 has a short downward slot 150 opening to slot 148 and permitting slide arm 146 to be rotated downwardly from an essentially horizontal position to a vertical position when the arm 146 registers with short slot 150. Short slot 150 is aligned with a bowed portion 152 formed in strut 76 to provide a recess for receiving slide arm 146 when rotated downwardly to its vertical position. This recess bowed portion 152 is of sufficient depth to permit slide arm 146 to be sandwiched between the flat section 70 of pivot arm 28 and strut 26 when the two are parallel and oriented side-by-side (FIGS. 1 and 5).

Slide bar latch 140 has a lid-engaging pad 154 formed as a pig-tail free end of slide bolt 142 to form a semi-circular rod abutment which extends radially outwardly from one end of slide bolt 142 such that the pad is displaced upwardly when bolt 142 is rotated by swinging slide arm 146 from a horizontal position downwardly in tube slot 150 to the vertical position shown in FIGS. 3–6. Rod pad 154 is constructed and arranged to snugly abut an inside surface of deck lid 12 when slide bolt 142 is extended from the cylindrical tube 144 and slide arm 146 then so rotated downwardly into short slot 150. Pad 154 is retracted away from the deck lid inside surface when slide arm 146 is rotated to its horizontal position and then slide bolt 142 retracted into tube 144. Pad 154 may be coated with a material such as Teflon which will prevent marring or damage to the deck lid, and may also take on any number of configurations which will conform to and accommodate any particular deck lid inside surface contour.

To prepare fixture 10 for use in the first stage installation to deck lid 12, the lock pin 58 is preferably removed from opening 56 in strut 26. Lock pin 58 is constructed and arranged such that its free end will retract into lock opening 74 in pivot arm 28, thereby allowing pivot arm 28 to be rotated downwardly about pivot pin 52 without striking lock pin 58 while pin 58 is retained in arm 28 (as shown in FIGS. 2 and 3) such that it cannot be lost or misplaced.

Figure 2:
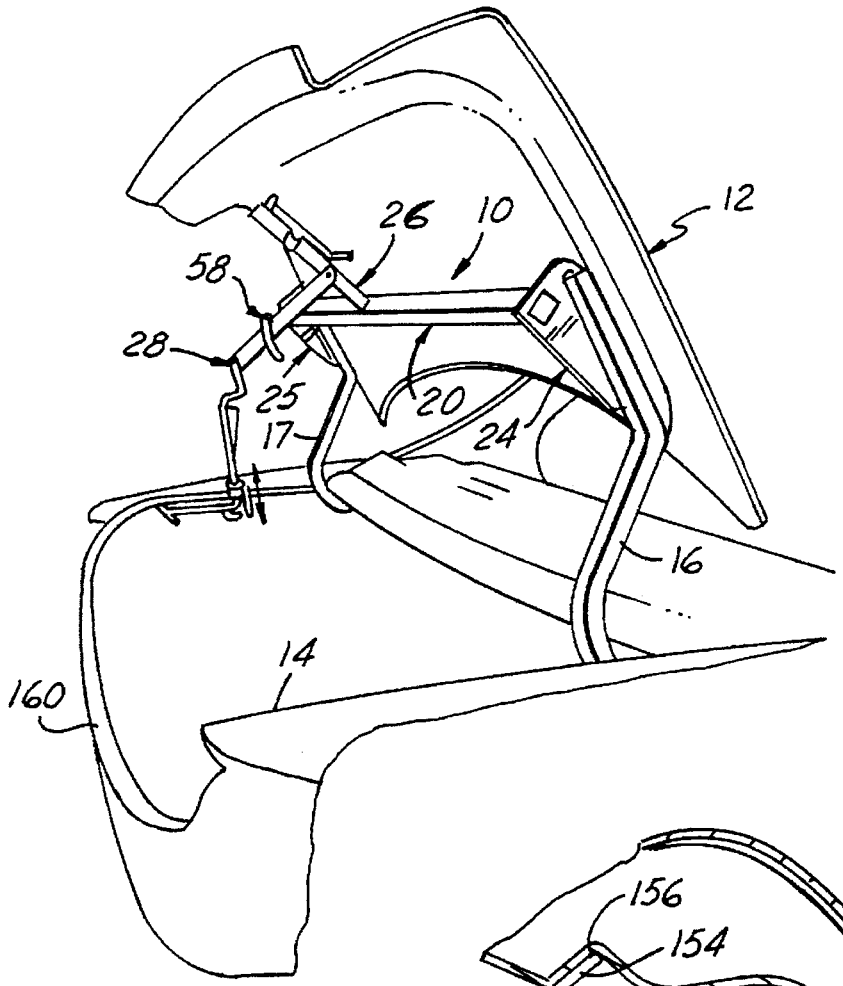
FIG. 2 is a fragmentary perspective view of the positioning fixture apparatus of FIG. 1 as being initially installed in supporting relation to a rear deck lid on a vehicle body structure, with portions broken away and portions in exploded view.

Fixture 10 is then ready to be installed under the fully open fiberglass deck lid of the vehicle body as best illustrated in FIGS. 2 and 3. Fixture 10 is manually lifted and maneuvered to orient hook members 24 and 25 respectively adjacent the rearward ends of hinge 16 and 17 of deck lid 12 with strut 26 closely below the rear latch area of the deck lid. The large hook 30 of each hook member 24, 25 is inserted into the associated one of the hinge arm open ends 40. With the rigid primary support 20 of fixture 10 so initially hooked at its front end to the hinge arms, fixture 10 is then bodily rotated downwardly slightly away from the deck lid inner surface until the abutment finger 38 of each hook member contacts the rear surface 39 of its adjacent hinge arm 16, 17 (FIG. 3). As shown in FIGS. 2 and 3, pivot arm 28 is suspended loosely in downwardly dependent position in abutment with tab 59 and is held in this position gravitationally with fixture so hooked onto hinge arms 16 and 17.

Next, slide bolt 142 is then extended from tube 144 rearwardly of fixture 10, by moving slide arm 146 along tube slot 158 and then rotating the slide arm downward into the tube short slot 150. This will rotate pad 154 upwardly so that it rests snugly against the inside surface of a bend recess 156 of the rear position of deck lid 12, as is best shown in FIG. 3. Strut 26 and slide latch 140 are preferably so dimensioned relative the particular structure, configuration and dimensions of a given deck lid 12 and associated vehicle trunk body model such that when latch 140 is so locked with pig-tail 154 so snugged, fixture 10 is securely retained on and straddling between the hinge arms 16 and 17 and deck lid lip 156 in a three-point suspension. Hence manipulating forces applied to fixture 10 rather than deck lid 12 will now move fixture 10 and deck lid 12 bodily as a pivoting unit.

The first step of the paint application process for a typical automotive vehicle body is to immerse the entire body in an E-coat primer bath. A typical E-coat bath is quite turbulent. Hence it is preferable to securely position the deck lid 12 at about a 30° angle relative to the remainder of the vehicle body or to horizontal, and also restrain deck lid movement either up or down out of this position. This is to ensure that the E-coat primer covers virtually all of the bare metal surface of the deck lid, and yet to ensure proper flow and coverage of the primer on the deck lid surface. This also ensures that puddles of undried E-coat primer will not collect between the layers of the deck lid construction. Fixture 10 could be designed to position the deck lid at a lesser or greater angle relative to the vehicle body, but hitherto in industry practice with E-coating of sheet metal deck lids the 30° angle has produced a quality surface finish while yielding the intended results.

To position the plastic composite deck lid 12 in the 30° open position using fixture 10 as so installed to lid 12, the operator manually grips T-handle 102 and pulls deck lid 12 downwardly towards the vehicle body (from the position of FIG. 3 to that of FIG. 4). When the deck lid is at approximately the correct angular orientation, pin 132 of slide pin latch 130 is lifted by the operator, thereby opening second notch 114 to receive therein the rearwardly facing edge of a lip flange 160 formed on the lower edge of the trunk opening of the vehicle body, as best illustrated in FIG. 4. Typically, an existing hole 162 in lip 160 will receive pin 132 therein when the operator releases the slide pin latch 130. Alternatively, slide pin latch 130 can be readily modified so that pin 132 overlaps the inner edge of trunk edge flange 160. The slide pin latch 130 will then trap lip 160 in notch 114 and therefore securely hold deck lid 12 steady in the 30° position as the vehicle body is passed through the E-coat bath.

Preferably when re-orienting deck lid 12 from the E-coat position of FIG. 4 to the paint line enamel and clear coat stages position of FIG. 5, pivot arm 28 is locked to strut 26 using the rod wing nut screw 58, as described previously. This enables fixture 10 to better restrain the up and down motion of lid 12 about its hinge pivot axis otherwise caused by vehicle body shake and vibration while being conveyed through the coating process, and also to resist flutter forces exerted on deck lid 12 when submerged in the turbulent E-coat bath.

Typically, the next stage of the paint application process involves adding the base color, and, if necessary, clear coat paint. It is preferred that the deck lid be held in an almost the closed generally horizontal position relative to a horizontally oriented vehicle body to achieve a consistent and comparable paint surface finish on the deck lid painted surface and the adjacent body panels of the vehicle body.

To re-orient and retain deck lid 12 in such almost closed position, fixture 10 is released from the 30° open position of FIG. 4 by the operator lifting the slide pin 132 and of latch 130 from hole 162 and pulling T-handle 102 upwardly and rearwardly to release body lip 160 from notch 114. The operator then lowers deck lid 12 toward its closed position by pulling downwardly on T-handle 102 until body trunk lip 160 is aligned forwardly of notch 110 so that the rearwardly protruding edge of clip 160 can be received in notch 110 (FIG. 5). T-handle 102 is then moved forwardly until lip 160 is received in notch 110 as shown in FIG. 5. The spring tension forces applied to hinge arms 16 and 17 applies upward pressure directly on fixture 10 which in turn tends to draw pivot arm 28 toward lip 160 to help retain lip 16 in notch 110. However, the weight of fixture 10 added to deck 12 generally will exceed lid counterbalance spring forces, and hence gravitational forces will help keep pivot arm 128 resting on trunk lip 160 in both FIG. 4 and FIG. 5 latched down positions of lid 12. Additionally, the hook catches 116 and 106 of arm 28 will prevent upward bouncing of fixture 10 and lid 12 when the vehicle body is subjected to conveyor bounce and/or lid 12 is being impacted by turbulent streams and eddy currents in the E-coat bath.

With deck lid 12 latched by fixture 10 as shown in FIG. 5, the vehicle body then passes through the various paint spray stations and booths as the desired paint coatings are applied to the vehicle body internal and external surfaces. When the paint application process is completed, the positioning fixture 10 is removed by pulling rearwardly on T-handle 102, thereby releasing notch catch 110 from body lip 160. By holding onto T-handle 102, the operator may raise fixture 10, as assisted by the spring hinge arms 16 and 17 to thereby controllably lift deck lid 12 to the fully open position.

In the fully open position of FIG. 2, the angulation of fixture 10 and deck lid 12 is such that the combined center of gravity of both acts through a short enough moment arm relative to the deck lid hinge pivot axis (assuming generally horizontal vehicle body orientation) such that the counterbalance spring forces are sufficient to maintain the assemblage of fixture 10 and deck lid 12 raised in the fully open position. Hence handle 102 provides a convenient exteriorly protruding hand grip for manipulating deck lid 12 between fully open and fixture-to-body latched positions without touching any part or surface of deck lid 12. This is particularly advantageous in the downstream paint operations following the E-coat primer bath dip, where the trunk deck lid 10 must be manually opened fully prior to entry into the automatic paint and clear coat spray booths in order to manually apply enamel and clear coat liquid materials with a hand-held spray gun to the inside surfaces of the body trunk and underside of deck lid 12. Use of fixture 10 also allows leaving the counterbalance torsion bar mechanism in place and fully operational throughout all coating stages, another important advantage in reducing body coating costs.

The three point attachment of fixture 10 to hinge arms 16, 17 and deck lid 12, and the cooperative open T-shape (in plan view) of fixture 10, minimize surface area of the deck lid underside and hinge arms covered over by the mounted engagement of fixture 10 to deck lid 12. Hence fixture 10 presents minimal obstruction to interior hand held spray gun applications coating materials to the underside of deck lid 12, and those minimal areas contacted and masked by the fixture are readily touched up after fixture removal.

In the fixture removal sequence, manipulating arm 28 will pivotally rotate downwardly relative to fixture strut 26 as deck lid 12 is raised by fixture manipulation, thereby providing clearance for the slide latch bolt 146 to be pivotally rotated from recess 152 to its horizontal unlatching position. Slide bolt 142 can then be retracted into the cylindrical tube 144 to thereby release pad 154 from fixture latching engagement with the internal surface of deck lid bend 156. The operator can then lift fixture 10 slightly toward lid 12 and pull fixture 10 rearwardly until hook fingers 30 of hook members 24 and 25 are released from engagement with the open end of hinge arms 16 and 17. Fixture 10 is then bodily removed as a unit by lifting it rearwardly and downwardly to remove it completely from beneath lid 12 and out of the vehicle body trunk cavity.

Fixture 10 may then be either be reused, cleaned or stored. To store fixture 10, pivot arm 28 is rotated until flat section 70 is parallel with strut 26 and lock opening 74 of pivot arm 28 is aligned with strut opening 56. Lock pin 58 then may be reinserted and threaded into the nut 64. Latch handle 146 will also then be locked in raised position so that pig-tail pad 154 is locked in its downwardly retracted position.

From the foregoing description and drawings as referenced therein, it will now be apparent that the vehicle body paneling positioning method and fixture apparatus for performing the method in accordance with the invention amply fulfill the aforementioned objects of the invention and provide many features and advantages over the prior art. In accordance with the method of the invention, the deck lid is manipulated and selectively positioned in various desired coating orientations by applying deck lid manipulating and positioning forces directly to the hinge arms rather than to the deck lid. This eliminates the aforementioned problems of deck lid manipulating and positioning forces causing bending and warpage stresses to the deck lid which otherwise cause coating defects. Hence a choice of materials for deck lid and other body panels likewise hinge-supported from the body can be vastly increased, including the aforementioned fiberglass based resins and other composite plastic materials which can be compression molded from a wide variety of sheet molding compounds now available. The vehicle trunk deck lid also can be readily manipulated as desired to selectively position the same for various types of coating application equipment and stages, as well as for handheld spray gun applications to the trunk interior and under surface of the deck lid, thereby obviating the costly problem of operators leaving finger print impressions on the uncured coating materials during production. Additionally, the prior costly procedure of decoupling the torsion bar counterbalance spring mechanism from the hinges in order to accomplish various phases of the coating process can be eliminated by manipulating and positioning the deck lid with forces evenly applied to the spaced hinge arms of the deck lid, both while manipulating the same and while holding the same steady in any given selected position.

The improved fixturing apparatus of the invention provides a rugged, economical and reliable apparatus for accomplishing the method of the invention which is easy to use as installed as well as attach and detach from cooperative orientation with the deck lid. The fixture apparatus provides a rigid primary support strut structure and associated hinge hook members so that down pull forces applied to fixture 10 via pivot arm 28 are distributed evenly to both hinge arms 16 and 17 to thereby avoid creating any torsional stresses on deck lid 12 which otherwise could result from unequal application of down pull as well as support and position maintaining forces to the laterally spaced hinge arms 16 and 17 at their free ends. The three-point attachment of fixture 10 accomplished with the engagement of the two hooks 24 and 25 and the third pig-tail support 154 also forms a three-point, lid-weight-load-supporting brace which relieves any lid-weight-induced stress in the deck lid from its cantilevered mounting on the hinges, thereby further relieving deck lid 12 of any such warpage or bending-inducing stresses in the first and second latch positions of FIGS. 4 and 5. That is, any weight self-loading of lid 12, as well as the weight of fixture 10 not counterbalanced through interconnection to the ends of the hinge arms 16 and 17, will be borne by the fixture manipulating arm 28 as it rests on and bears downwardly upon the rear trunk lip 160.

From the foregoing description it will also now be apparent to those skilled in the art that the principles and features of the present invention may take various forms without departing from the spirit and scope of the invention. For example, various other means may be provided for attaching fixture 10 to the ends of the hinge arms 16 and 17, as by outwardly acting spring clamps telescoped into the open ends of the channels and affixed to the opposite ends of a telescopically adjustable cross bar strut. With the ends of the hinge arms so clamp-engaged, a length of cable may be attached at its opposite ends one to each and of the cross bar or associated spring clamp. The cable may have a length about twice that of the span between the hinge arms, and a pulley bar can be trained to run along the center area of he cable. A pull cord chain or another cable attached to the pulley can then be used to manually pull the hinge arms down to the selected lid orienting positions. The pull cord may be suitably provided with attachment implements to hook the same to the lower rear edge of the body trunk opening structure. For example, appropriately spaced hooks could be provided along the pull down cord to provide the preselected E-coat position of FIG. 4 and the enamel and clear coat application position of FIG. 5. One or more suitable prop sticks or other similar propping devices may be attached to the pull cord so that they are readily available to sequentially select and use as a prop between the trunk lip 156 and the bottom deck of the trunk opening. These different length props, like arm 28, will bear whatever loading exists at the rear edge of the deck lid from its own weight as cantilevered from the lid hinges, and also support and stabilize the fixture and lid in the selected orientations. Of course, other equivalent fixturing means now will also be apparent to those skilled in the art from the foregoing disclosure for practicing the principles of the method of the invention.

Accordingly, it is also to be understood that, although the foregoing description and drawing describe and illustrate in detail various preferred embodiments of the present invention, to those skilled in the art to which the present invention relates the present disclosure will suggest many modifications and constructions as well as widely differing embodiments and applications without thereby departing from the spirit and scope of the invention. The present invention, therefore, is intended to be limited only by the scope of the appended claims and the applicable prior art.

We claim:

1. A positioning fixture for selectively positioning a vehicle body panel during the application thereto paint find/or other coating material, and wherein the panel has a generally horizontally oriented closed position relative to a horizontally oriented vehicle body and is cantilevered carried on the vehicle body by the hinge-remote ends of a pair of spaced apart spring-counterbalanced hinge arms for bodily pivotal motion therewith in a generally vertical travel path about the pivot axis of the hinge arms to be held in a raised open position by spring counterbalance forces exerted on the hinge arms, and wherein the hinge arms are tubular members open at the hinge-remote ends thereof, said positioning fixture comprising, a substantially rigid primary support having a non-rotatable torsionally rigid main strut for spanning lengthwise the distance between said hinge arms, a pair of hook members fixed to said primary support and each being disposed for removable attachment to an associated one of said hinge arms, each of said hook members comprising a body with a hook portion protruding therefrom and removably insertable into the associated open end of the associated hinge arm and a main body portion extending along and abutting said hinge arm when said hook portion is inserted into said associated hinge arm open end, a manipulating arm having one end pivotally connected to said primary support for downward pivotal movement of said arm relative to said primary support and hook member in a path generally parallel to the body panel pivot path, a first catch means located on said manipulating arm spaced remote from said and one end for releasably attaching to said vehicle body to angularly orient and support in tension against the spring-counterbalancing force said hinge-remote ends of said hinge arms and hence said body panel carded thereon in a predetermined first orientation position relative to said vehicle body, and a second catch means located on said manipulating arm and spaced therealong from said first catch means for releasably attaching to said vehicle body to angularly orient and support in tension acting against the spring-counterbalancing force exerted on said hinge-remote ends of said hinge arms and hence said body panel carded thereon in a predetermined second orientation position relative to said vehicle body.

2. The fixture of claim 1 wherein said primary support further comprises a secondary strut rigidly affixed to said main strut at about the longitudinal mid-point thereof and extending therefrom with it longitudinal axis generally perpendicular to the main strut longitudinal axis and having an end remote from said main strut constructed and arranged to cooperate with said hook members to provide lid-support and fixture-securing engagement with the body panel underside at a point remote from the ends of said hinge arms.

3. The fixture of claim 2 wherein said manipulating arm is pivotally carried by said secondary strut side-by-side therewith.

4. The fixture of claim 3 wherein said manipulating arm further comprises a straight section pivotally attached at one end to said secondary strut for angular pivotal movement relative thereto and a vehicle body attachment section affixed to the opposite end of said arm straight section for movement therewith and including said first and second catch means.

5. The fixture of claim 1 wherein said main strut is constructed as an elongate box channel.

6. The fixture of claim 5 wherein each of said hook members is rigidly affixed to the opposite ends of said main strut.

7. The fixture of claim 2 in combination with said body panel, and wherein said panel comprises a deck lid constructed primarily of a non-metallic material such as fiberglass filled resin or plastic composite sheet molding compound.

8. The fixture and panel combination of claim 7 wherein said first catch position is constructed and arranged to provide a first almost closed panel orientation position defined by said deck lid being almost closed at an angle of slightly more than about 0° relative to the normally horizontal longitudinal axis of said vehicle body.

9. The fixture and panel combination of claim 8 wherein said second catch position is constructed and arranged to provide a second partially closed panel orientation position defined by said deck lid being open about 30° relative to the normally horizontal longitudinal axis of said vehicle body.

10. The fixture of claim 2 wherein said secondary strut has an adjustable latch abutment member carried thereon adapted for releasable engagement with a complementary underside portion of the body panel at a location spaced remote from the panel carrying ends of said hinge arms to thereby provide with said hook members a three-point releasable attachment of said fixture to said hinge arms and panel underside.

11. The fixture of claim 10 wherein said manipulating arm is pivotally attached to said secondary strut for pivotal movement between a retracted position alongside said secondary strut in the predetermined first panel orientation position and a dependent position angulated relative to said secondary strut in the predetermined second panel orientation position.

12. The fixture of claim 11 wherein said fixture includes fastening means for rigidly releasably intercoupling said manipulating arm and secondary strut in the retracted position of said manipulating arm.

13. The fixture of claim 12 wherein said second catch means comprises a releasable latch mechanism and said first catch means comprises a hook notch (110).

14. A positioning fixture for selectively positioning a vehicle body panel during the application thereto of paint and/or other coating material, and wherein the panel has a generally horizontally oriented closed position relative to a horizontally oriented vehicle body and is cantilever carried on the vehicle body by the hinge-pivot-remote ends of a pair of spaced apart spring counterbalanced hinge arms for bodily pivotal motion therewith in a generally vertical travel path about the hinge axis from the closed position to a raised open position by spring counterbalancing forces exerted on the hinge arms, said fixture comprising means constructed and arranged for removable coupling between the vehicle body and the pivot-remote ends of the hinge arms for applying tension forces directly to the pivot-remote ends of the hinge arms while acting against the counterbalance spring forces acting on the hinge arms to thereby hold the hinge arms and thus indirectly through the hinge arms thereby hold the associated body panel stationary relative to the vehicle body in a selected orientation position between fully closed and fully oldened relative to the vehicle body for application of coating material to the body panel.

15. The positioning fixture means of claim 14 further including torsionally rigid strut means for applying manipulating tension forces directly to the hinge arms and thereby indirectly through the hinge arms to the panel to thereby move the panel to the selected stationary coating application position.

16. The positioning fixture means of claim 15 further including rigid strut extension means for stationarily supporting the weight of the portion of the panel most remote from the hinge pivot axis during the step when the panel is being held in said selected coating application position.

17. In combination, an automotive vehicle body adapted to be oriented with its overall length and width dimensions generally horizontal for application of coating material to said vehicle body, said body including a body compartment and a pair of spring counterbalanced hinge arms disposed in said compartment and spaced apart therein transversely of the vehicle body longitudinally axis for pivotal motion about a hinge axis generally parallel to the body width dimension, said hinge arms having free ends spaced remote from the hinge axis of said arms, said vehicle body further including a body panel for opening and closing access to said body compartment, said body panel having a generally horizontally oriented closed position relative to said vehicle body when horizontally oriented and being cantilever carded on said vehicle body by said hinge-pivot-remote ends of said hinge arms for bodily pivotal motion therewith in a generally vertical travel path about the hinge axis upwardly to be held in a raised open position by spring counterbalance forces exerted on said hinge arms, and positioning fixture means generally removably disposed in said body compartment and being operably removably coupled between said vehicle body and said hinge arms for selectively positioning said body panel relative to said vehicle body during the application thereto of paint and/or other coating material, said fixture means comprising hinge arm attachment means for applying forces directly to said hinge arms acting against the counterbalance spring forces to thereby thus hold the hinge arms stationary and thereby hold said body panel indirectly through the hinge arms stationary relative to said vehicle body in a selected orientation position between fully closed and fully opened relative 16 the vehicle body compartment for application of coating material to said body panel.

18. The combination as set forth in claim 17 wherein said positioning fixture means further includes rigid non-rotatably strut means constructed and arranged for manually applying manipulating forces via said hinge arm attachment means directly to said free ends of said hinge arms and thereby to hold said panel indirectly through said hinge arms into the selected stationary coating application position.

19. The combination set forth in claim 18 wherein said strut means of said positioning fixture means further includes adjustable panel engaging means constructed, and arranged for stationarily supporting the weight of the portion of said panel most remote from the hinge pivot axis when said panel is being held in the selected coating application position.

* * * * *

UNITED STATES PATENT AND TRADEMARK OFFICE

CERTIFICATE OF CORRECTION

PATENT NO. : 5,653,805

DATED : August 5, 1997

INVENTOR(S) : Charles T. Russell and Gerald G. Kilgore, Jr.

It is certified that error appears in the above-indentified patent and that said Letters Patent is hereby corrected as shown below:

Col 11, Line 4, change "find" to "and".

Col 11, Line 18, change "fixed" to "affixed".

Col 11, Line 34, change "and" to "arm".

Col 11, Line 38, change "carded" to "carried".

Col 11, Line 47, change "carded" to "carried".

Col 11, Line 52, change "it" to "its".

Col 11, Line 59, delete "side-by-side" and insert in place thereof "in laterally overlapping relationship with said secondary strut".

Col 12, Line 1, change "claim 1" to "claim 4".

Col 12, Line 63, change "oldened" to "opened".

Col 13, Line 22, change "carded" to "carried".

Col 14, Line 10, change "16" to "to".

Col 14, Line 23, remove the comma (,) after "constructed".

Signed and Sealed this

Twenty-seventh Day of January, 1998

Bruce Lehman

*Attest:*

BRUCE LEHMAN

*Attesting Officer*

*Commissioner of Patents and Trademarks*